United States Patent [19]

Pardo Herrera

[11] Patent Number: 4,564,964

[45] Date of Patent: Jan. 21, 1986

[54] RETAINING ELEMENT FOR SWINGING WEIGHTS

[75] Inventor: José Pardo Herrera, Saragossa, Spain

[73] Assignee: Industrias Hidraulicas Pardo S.A., Spain

[21] Appl. No.: 510,398

[22] Filed: Jul. 1, 1983

[51] Int. Cl.[4] ..... A47C 17/40

[52] U.S. Cl. ..... 5/164 R; 5/136; 5/166 R

[58] Field of Search ..... 5/166, 164, 136, 133, 5/137, 162

[56] References Cited

U.S. PATENT DOCUMENTS 425,378 4/1890 Herrinton ..... 5/164 D

FOREIGN PATENT DOCUMENTS 1104919 11/1955 France ..... 5/164 R

*Primary Examiner*—Alexander Grosz

*Attorney, Agent, or Firm*—Ostrolenk, Faber, Gerb & Soffen

[57] ABSTRACT

A retaining element for swinging weights includes two supporting parts which are spaced apart along a covering. The covering is pivotable around a shaft of rotation between two angular positions. A short arm, which is fixed against pivoting on the shaft of rotation, extends obliquely to the direction of extension of the covering and the direction between the supporting parts. One of the supporting parts is pivotally connected through a rod, to the free end of the oblique arm. Stretchable elements extend between the spaced supporting aparts. Pivoting of the covering between its angular positions pulls the supporting parts apart or permits them to move together, varying the tension on the stretchable elements. The second supporting part is supported on a threaded rod which permits adjustment of the tension of the stretchable elements.

6 Claims, 1 Drawing Figure

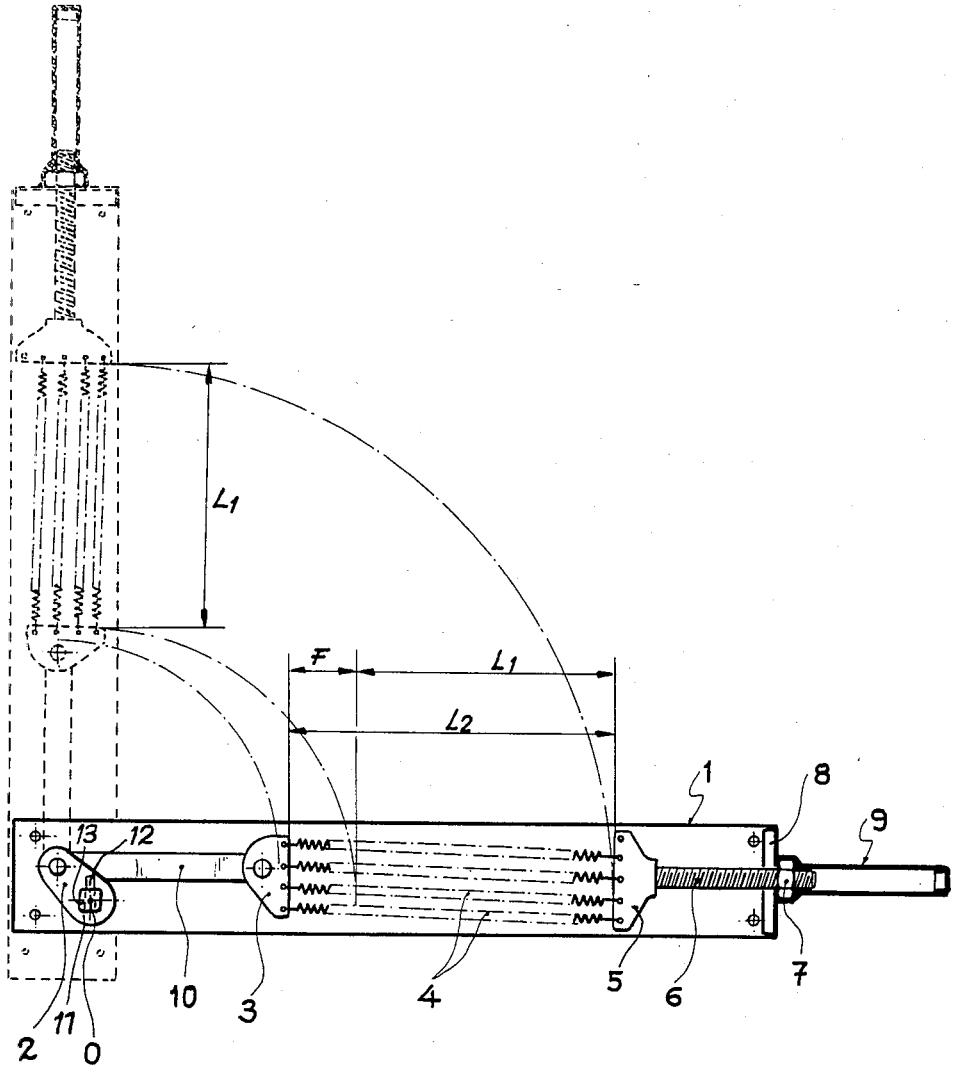
L1
F
L1
L2
1
8
9
13
12
10
3
4
5
6
7
2
11
0

RETAINING ELEMENT FOR SWINGING WEIGHTS

SUMMARY OF THE INVENTION

The present invention relates to the construction of a retaining element for swinging weights. The invention can be applied to a bed that is formed simply of a bedspring and which bed is capable of being concealed within an article of furniture or within a niche.

The retaining element of the invention comprises a series of elastic elements of variable nature, which are fastened at both their ends to corresponding supports. One of the supports is, in turn, secured to a threaded rod which is suitably, threadedly anchored so that by actuating the threaded rod, the tension of the elastic elements can be varied. The other support end is fastened to a part mounted on a short arm that is, in turn, secured to the shaft of rotation of the bedspring. This entire assembly is contained within a suitable cover which can form part of the frame for the spring. Depending upon whether the frame is in an extended, i.e. lowered, position or an upraised, i.e. folded back, position, and due to the different lengths of the springs, which lengths vary depending upon the position of the article of furniture and therefore upon the relative positions between the short arm and the end support part bearing the elastic elements, it is possible for the article of furniture to hold itself at any inclined position, including positions intermediate its extreme positions of extended or folded back. This eliminates the possibility of accidents caused by negligence or by momentary abandonment of the folding or unfolding procedure.

When the retaining element of the invention is connected to the bedspring-door assembly of an article of furniture, it can be rapidly dismounted in order to facilitate the transportation or removal of this type of furniture.

For a better understanding of this disclosure, refer to the accompanying drawing which shows one embodiment of retaining element of the invention.

The drawing FIGURE diagrammatically shows an arrangement of the retaining element in two positions, the folded up position is shown in dashed lines and the other folded down position is shown in solid lines.

The retaining element comprises a frame or cover 1 which is pivoted at one end on a non-rotating shaft 0. That shaft is provided at its ends with a polygonal section, which facilitates its assembly. The polygonal section 13 of the shaft 0 has a threaded hole 11 into it which, after introduction of a screw 12 into the hole, makes it possible to level a front concealing panel of the swinging weight. That swinging weight is a bed spring to which the panel is attached.

Secured firmly and thus non-rotatably to the non-rotatable shaft 0, is a short arm 2. As the frame pivots between its dashed and solid line positions, the arm 2 remains stationary, as shown by the arm 2 having only a solid line position. The arm 2 extends obliquely up from the shaft 0, and it is also oblique to the below described rod 10. The arm 2 has an opposite free end to which is pivotally fastened a connecting rod 10 of suitable length shorter than the frame. At the free end of the rod 10, there is mounted a part of yoke 3. On that part 3 are anchored a plurality of stretchable elements 4, preferably eight, arranged in two planes or rows of four each. The stretchable elements 4 may be conventional springs or other suitable elastomeric elements. The connecting rod 10 avoids possible interference between the stretchable elements 4 and the cover 1.

The elements 4 extend along the frame and are attached at their free ends to support part 5. The parts 3 and 5 are spaced apart along the frame. The support is fastened to a coaxial threaded rod 6 having a free end which passes through an end 8 of the cover 1. Outside the end 8, the rod 6 receives a nut 7. Turning of the nut 7 on the rod 6 and against the end 8 causes the elastic elements or springs 4 to be tensioned or relaxed. This enables adjustment of the working tension of the elements 4 to facilitate the swinging movement of the article of furniture fastened to the cover 1. Due to the relative position between the arm 2 and the part 3 carrying the springs 4 and the oblique orientation of the arm 2, when the cover 1 is in its vertical, dashed line position, the length $L_1$ of the springs 4 is less than their length $L_2$ when they are in the horizontal position, because the point of articulation between arm 2 and part 3 is further from the threaded rod 6. This is apparent from the FIGURE, because in the upraised condition, due to the arm 2, the frame is vertically down far enough to shorten the springs.

The nut 7, which makes it possible to adjust the tension of the elastic elements 4, is thermally covered by a suitable plastic material 9 of suitable length. This is to improve the appearance of the frame by concealing the end of the threaded rod 6. At the same time, the extension of the material 9 in the shapé of a rod, facilitates the pretensioning of the springs 4 by actuating the thermoplastic covering 9 manually or by means of a wrench.

When the retaining element has been mounted on a swinging bed, the bed can be held at any intermediate position, thereby precluding the possibility of any type of accident.

Minor details, both of the assembly and of the parts of the invention, may be modified, provided that such changes do not impair the essence, which is summarized in the following claims.

I claim:

1. A retaining element for a swinging weight, comprising a covering secured to the swinging weight; a shaft of rotation to which the covering is pivotally attached for the covering to pivot around the shaft between two angularly spaced apart positions;

first and second spaced apart support parts, which are spaced a distance apart from each other along the covering; a plurality of stretchable elements stretched between and attached on the support parts and being normally biased to pull the support parts together;

an arm fixed to the shaft of rotation and fixed thereto against rotation as the covering pivots; the first of the support parts being pivotally connected to the arm at a location spaced from the shaft of rotation; the arm extending in a direction that oblique to the direction between the support parts, whereby as the covering pivots between its extreme positions while the arm remains stationary, the arm pulls the first support part to which it is attached selectively away from the other of the parts when the covering pivots in one direction and permits the first part to move toward the other part when the covering pivots in the other direction, respectively stretching and permitting return of the stretchable elements.

2. The retaining element of claim 1, further comprising means attached to the second of the support parts for adjusting the spacing of the second part from the first of the parts, thereby for adjusting the tension of the stretchable elements.

3. The retaining element of claim 2, wherein the adjusting means comprises a threaded rod attached to the second part and comprises a nut supported on the covering and threaded over the rod, such that rotation of the nut moves the rod and thereby adjusts the position of the second part.

4. The retaining element of claim 3, further comprising a thermoplastic covering over the nut for concealing the end of the rod and the nut and for serving as a handle for rotation of the nut.

5. The retaining element of claim 1, wherein the shaft of rotation has a polygonal cross-section and the arm has a corresponding opening which mates with the shaft.

6. The retaining element of claim 5, wherein the polygonal section of the shaft has a threaded hole, and a front panel being supported to the shaft by a screw introduced into the threaded hole, the panel being adapted to conceal the swinging weight.

* * * * *